US007431397B2

(12) United States Patent
Link

(10) Patent No.: US 7,431,397 B2
(45) Date of Patent: Oct. 7, 2008

(54) CHAIR

(75) Inventor: Werner Link, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 395 days.

(21) Appl. No.: 11/226,871

(22) Filed: Sep. 14, 2005

(65) Prior Publication Data

US 2006/0082201 A1 Apr. 20, 2006

(30) Foreign Application Priority Data

Oct. 18, 2004 (DE) ..... 10 2004 050 853

(51) Int. Cl.
*A47C 1/032* (2006.01)

(52) U.S. Cl. ..... 297/302.4; 297/302.1; 297/302.7

(58) Field of Classification Search ..... 297/302.1, 297/302.3, 302.4, 302.5, 302.7, 300.2, 300.4
See application file for complete search history.

(56) References Cited

U.S. PATENT DOCUMENTS 4,858,993 A 8/1989 Steinmann
4,892,354 A * 1/1990 Estkowski et al. ..... 297/303.3
4,966,411 A * 10/1990 Katagiri et al. ..... 297/300.7
5,052,753 A * 10/1991 Buchacz ..... 297/300.3
5,207,479 A * 5/1993 Wickman et al. ..... 297/303.4
5,388,889 A * 2/1995 Golynsky ..... 297/302.3
5,511,852 A * 4/1996 Kusiak et al. ..... 297/301.4
5,577,802 A * 11/1996 Cowan et al. ..... 297/301.2
7,281,764 B2 * 10/2007 Thole ..... 297/303.4

FOREIGN PATENT DOCUMENTS

DE 37 27 784 A1 3/1989
DE 90 02 416 6/1990
DE 44 03 123 8/1995
DE 297 04 906 U1 7/1997

* cited by examiner

*Primary Examiner*—Peter R. Brown
(74) *Attorney, Agent, or Firm*—Michael J. Striker

(57) ABSTRACT

A chair has a seat, a center column, a seat support bar joined to the center column, and a mechanism provided for securing the seat with adjustable inclination to the seat support bar and including a toggle lever assembly.

9 Claims, 5 Drawing Sheets

Fig. 4a
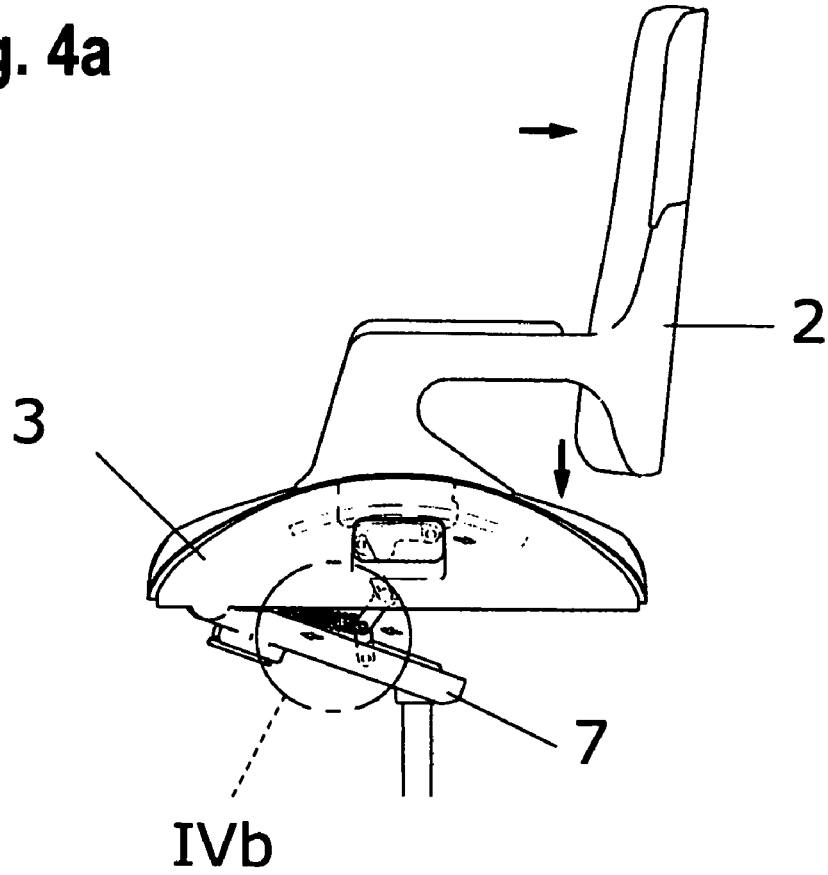
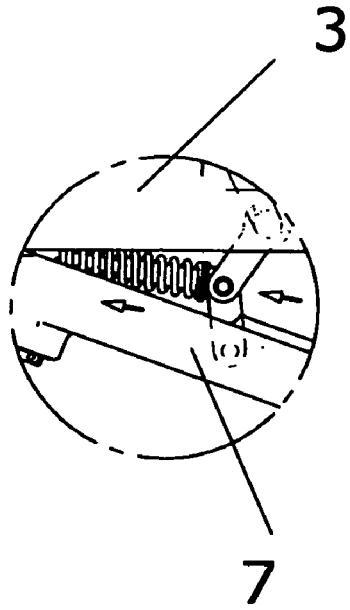
Fig. 4b

CHAIR

CROSS-REFERENCE TO A RELATED APPLICATION

The invention described and claimed hereinbelow is also described in German Patent Application DE 10 2004 050 853.4 filed on Oct. 18, 2004. This German Patent Application, provides the basis for a claim of invention under 35 U.S.C. 119(a)-(d).

BACKGROUND OF THE INVENTION

The present invention relates to a chair, having a seat and a mechanism for securing the seat with adjustable inclination to a seat support bar that is connected to a center column.

Such a chair may for instance be an office chair, conference chair, visitor's chair, or the like. The inclination of the seat and/or of the backrest may be adjustable.

German Patent Disclosure DE 44 03 123 A1 describes a synchronous adjustment, in which the ratio between the inclination of the seat and the inclination of the backrest is adjustable. The synchronous adjusting mechanism is formed here by a plurality of pivotably connected-together parts and by a force-storing element, in this case a gas spring. Because of the large number of component parts, the known synchronizing mechanisms are relatively complicated and expensive, however. Moreover, the service life of the known adjusting mechanisms is limited, because of the large number of moving parts that are hence subject to wear.

In German Utility Model DE 297 04 906 U1, a chair with a synchronous adjustment is presented, in which the seat surface is secured to the chair column by means of a first, elastically deformable spring element. The backrest is secured, via a backrest support bar, to a second elastically deformable spring element that is coupled to the first spring element. The first spring element, or the seat surface, is moreover connected elastically or pivotably to the second spring element or to the backrest support bar. As a result, the aforementioned disadvantages of earlier mechanisms for synchronous adjustment are partly avoided, and in particular a long service life and a minimum of noise upon actuation are achieved. However, in this version as well, many mechanical parts are provided, making for a corresponding amount of effort of assembly and risk of wear. Moreover, with it, arbitrary, continuously variable relative adjustment of the seat surface and backrest cannot be attained.

SUMMARY OF THE INVENTION

Accordingly, it is an object of the present invention to refine a chair in such a way that only a minimum number of mechanically moved parts is required; synchronous adjustment of the seat support bar and backrest in a simple way should also be possible and should be arbitrarily adjustable, and the course of motion of the adjustment should be effected in a continuously variable way and more gently than in previous versions.

This object is attained by a chair having a seat and having a mechanism for securing the seat, in a way such that its inclination is adjustable, to a seat support bar that is connected to a center column; the mechanism includes a toggle lever assembly. By the use of a toggle lever assembly, the reclining motions can be adjusted arbitrarily and in a continuously variable way, and the courses of motion are optimally gentle. The number of mechanical elements for the adjustment, such as joints, can be reduced to a minimum. In particular, complicated mechanical spring elements and wear-threatened gear or booster devices are eliminated completely.

In a preferred embodiment, the toggle lever assembly includes a first lever, secured to the seat at a stationary center shaft, and a second lever, pivotably connected to the seat support bar at a stationary pivot shaft, the two levers being pivotably connected to one another at a shiftable pivot shaft, and means for connecting the pivot shaft to the seat being provided. The seat and the seat support bar can thus be joined together in a simple way.

For varying the adjustment of the seat inclination, which adjustment is dependent on the pressure exerted by the seated person, the pivot shaft is connected, via a telescoping element and a further lever, to a torsion bar, and the lever is connected to the torsion bar in a manner fixed against relative rotation.

In a simple technical embodiment, the telescoping element may be embodied by a pin that is capable of being introduced into a receptacle counter to the force of a compression spring.

For adjusting the inclination of a backrest, the chair can additionally have a mechanism for adjusting the inclination of a backrest.

An elegant way of embodying the adjustment of inclination is obtained by providing that the backrest is connected, via a backrest support bar, to a sliding piece which is displaceably supported on the seat. The backrest may be secured laterally to the seat.

Preferably, a curved bar is provided, on which the sliding piece is supported. Hence the adjustment of the inclination of the backrest results in an agreeable relaxed position.

One sliding piece may be mounted on one side of the seat, diametrically opposite the other sliding piece, and the two sliding pieces are secured each via a respective connecting element to the center shaft. The motion of the two sliding pieces is effected synchronously.

For synchronized reclining of the seat and backrest, it is provided that the first lever of the toggle lever assembly is connected to the rotatable center shaft in a manner fixed against relative rotation; as a result, when the seat is lowered, via the first lever, the center shaft is rotated, and as a result the sliding pieces are shifted to the rear via the connecting elements. Because of this, the backrest sinks together with the seat toward the rear. The angle formed by the first lever and the two connecting elements, all of which are secured to the center shaft, determines the extent to which the backrest is lowered along with the seat.

For locking the reclined backrest, a gas spring may be provided for locking the sliding piece.

A preferred exemplary embodiment of the invention is shown schematically in the drawings and will be described in conjunction with the drawings.

BRIEF DESCRIPTION OF THE DRAWINGS

FIG. 4*a* is a side view of a seat, without the seat and seat back being reclined;

FIG. 4*b* is an enlarged view of a detail of the side view of FIG. 4*a;*

DESCRIPTION OF THE PREFERRED EMBODIMENT

Figure 1:
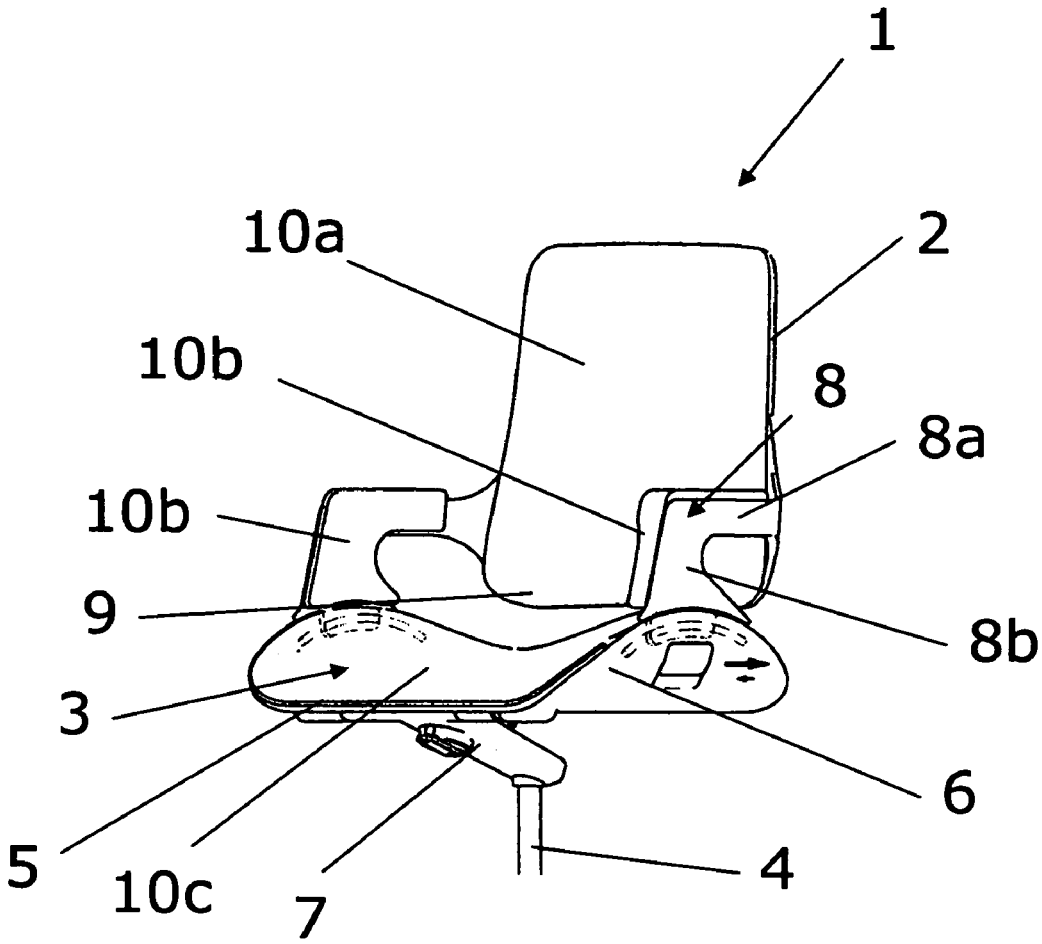
FIG. 1 is a perspective view of a chair.

In FIG. 1 shows the construction of a chair 1. It substantially includes a backrest 2, a seat 3, and a center column 4 joined to an undercarriage, not shown, that is movable via wheels.

The seat 3 has a shell shape, with a flat middle part 5 and two cheeks 6 on the side that are drawn upward in the direction of the backrest 2. The seat 3 is mounted on the center column 4 via a seat support bar 7.

The backrest 2 is joined to the cheeks 6 via two L-shaped backrest support bars 8, transverse to the backrest 2, one of whose arms 8*a* is connected fixedly to the backrest 2 and the other of whose arms 8*b* is pivotably connected movably to the cheek 6. Because of the L shape of the backrest support bars 8 and their location laterally, the backrest 2 is spaced apart from the rear seat region of the seat 3, below the lower region 9 of the backrest, facing toward the seat. The arm 8*b* likewise has a spacing from the rear seat region.

The backrest support bars 8 laterally surround the seat ends and can be used as armrests. The backrest 2, seat 3 and backrest support bars 8 are covered with upholstery 10*a* through 10*c*.

Figure 2:
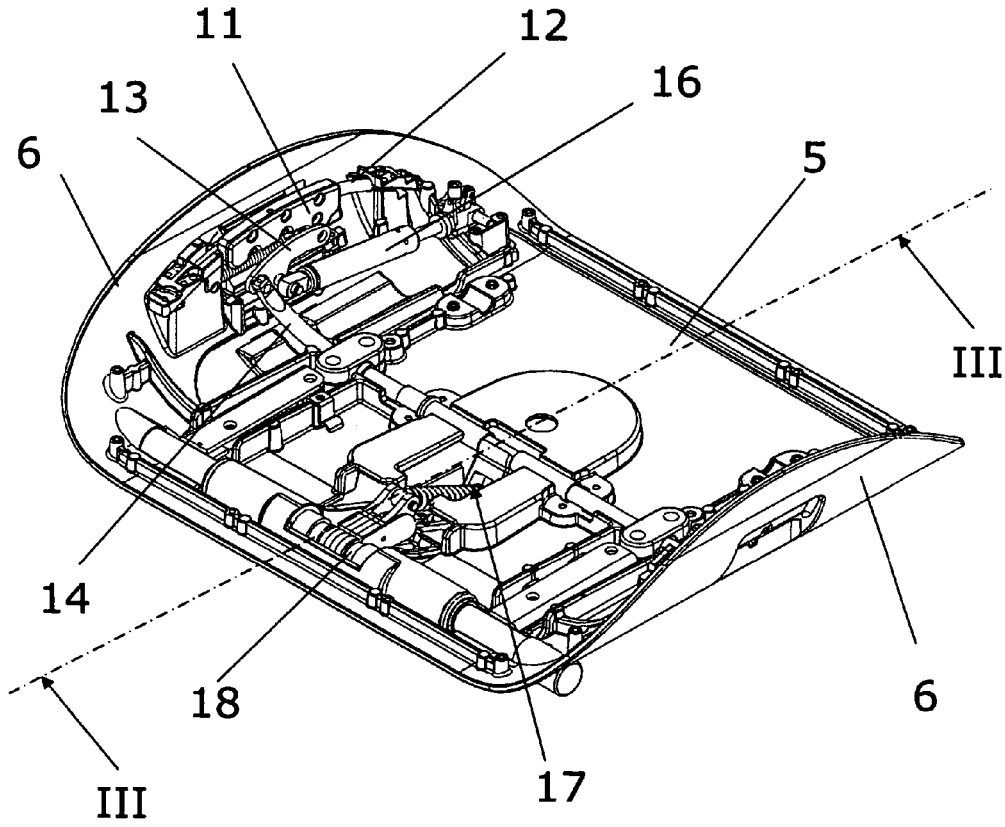
FIG. 2 is a perspective view of a seat of the chair without the seat cushion.

FIG. 2 clearly shows the shape of the seat, with the flat middle part 5 and the upward-drawn cheeks 6, for receiving a mechanism for synchronously controlling the inclination of the seat and of the backrest.

The arm 8*a*, not shown in FIG. 2, of the backrest support bar 8 is fixedly joined to a sliding piece 11, which is displaceable on a curved bar 12 of round cross section, for generating a vertical basic position and a reclined relaxed position of the backrest. The pivotable connection of the backrest support bars is embodied identically on the two insides of the cheeks 6. For synchronously moving the two sliding pieces 11, the sliding pieces are each connected via a respective connecting element 13 to a rotatable center shaft 14. The displacement of the sliding pieces 11 is effected in each case counter to the spring force of a tension spring 15, and thus the sliding pieces 11 and hence the backrest automatically return to the basic position. For locking the sliding piece 11, a gas spring 16 is provided, which is connected to the connecting element 13. If adequate pressure is built up in the gas spring 16, the motion of the connecting element 13 and hence the further displacement of the sliding piece 11 is blocked.

The center shaft 14 also forms the interface between the adjustment of the inclination of the backrest and the adjustment of inclination of the seat. The center shaft 14 is engaged by a toggle lever assembly 17, which makes it possible to incline the seat 3 relative to the seat support bar 7 and which controls the adjustment of inclination as a function of the shift in weight of the person seated. The toggle lever assembly 17 is connected on the other side to a torsion bar 18, which is supported at its ends in stationary fashion on the seat 3 and which forms the pivot shaft for the seat 3.

Figure 3:
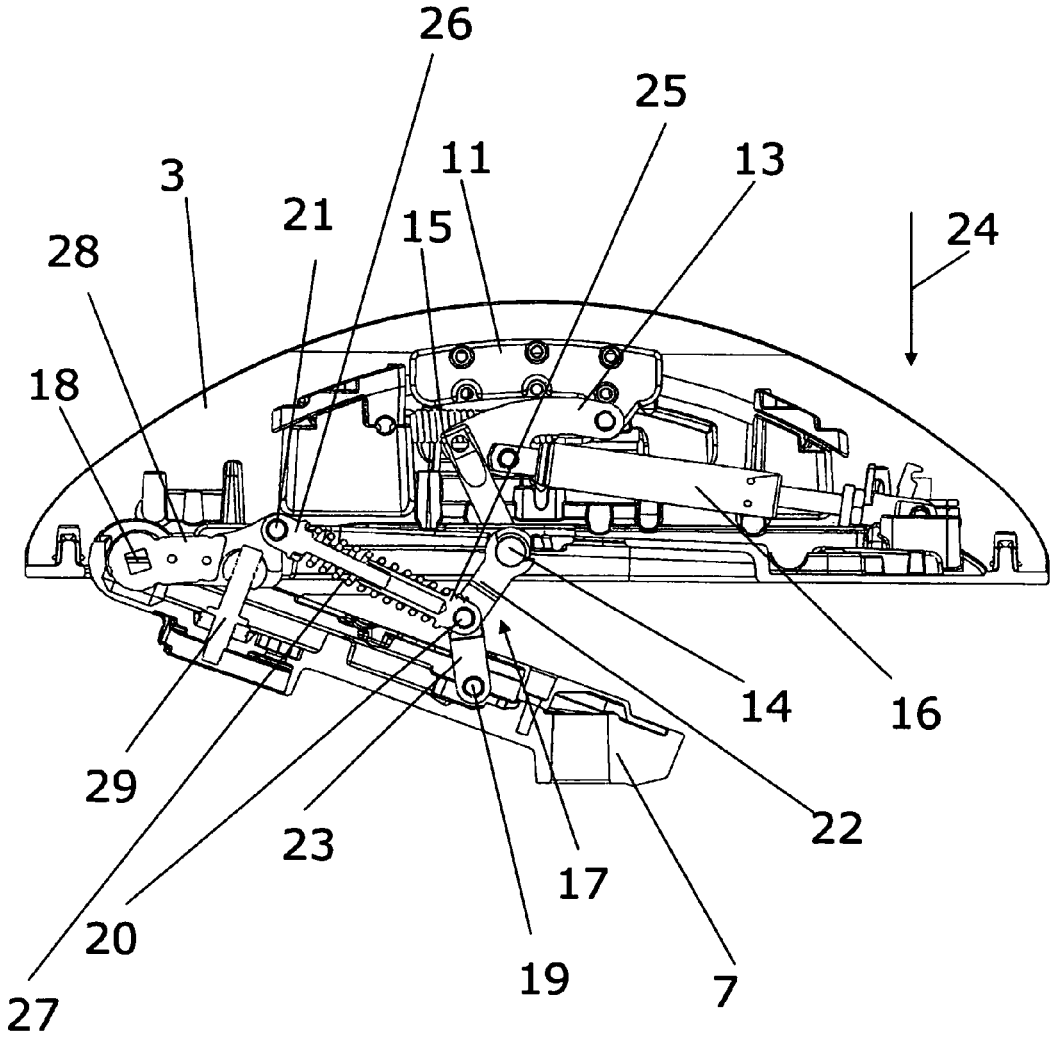
FIG. 3 is a section through the seat taken along the line III-III in FIG. 2.
Figure 5A:
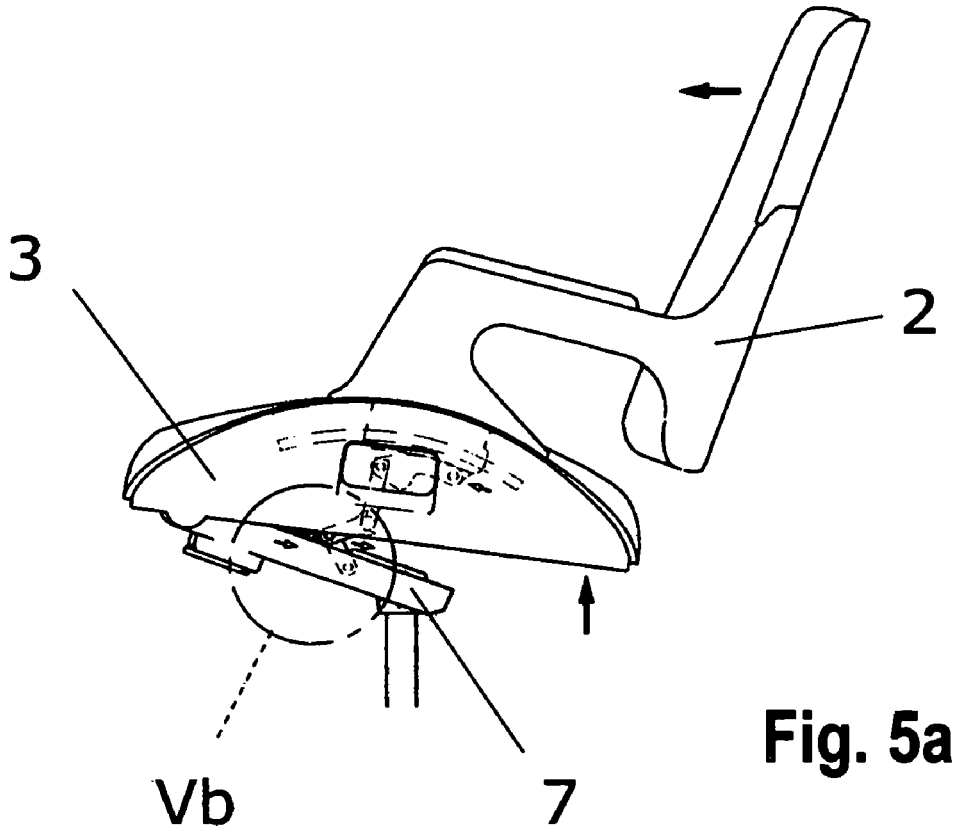
FIG. 5*a* is a side view of the seat with the seat and the seat back reclined.
Figure 5B:
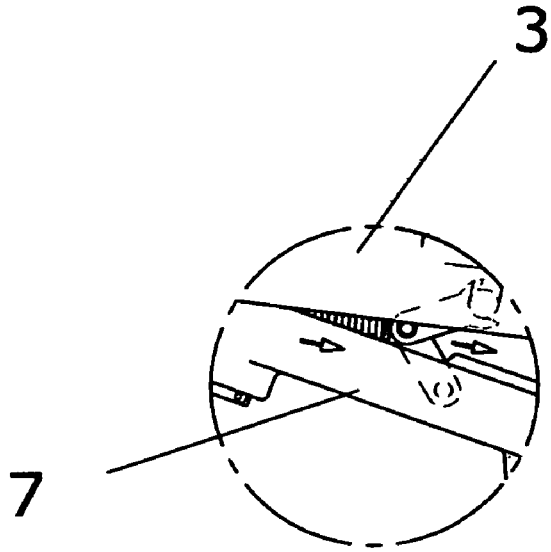
FIG. 5*b* is an enlarged view of a detail of the side view in FIG. 5*a.*

As can be seen from FIG. 3, the toggle lever assembly 17 includes a first pivot shaft, located in stationary fashion on the seat 3 and embodied by the center shaft 14; a second pivot shaft, located in stationary fashion on the seat 3 and embodied by the torsion bar 18; a third pivot shaft 19, located in stationary fashion on the seat support bar 7; a shiftable fourth pivot shaft 20; and a shiftable fifth pivot shaft 21.

A first lever 22 is located in a manner fixed against relative rotation on the center shaft 14 and connected, via the fourth pivot shaft 20, to a second lever 23, which is pivotably supported on the seat support bar 7. If pressure is now exerted on the seat 3 in the direction of the arrow 24, the levers 22 and 23 are moved counter to one another about the pivot shaft 20, and a receptacle 25 and a pin 26 are pushed together counter to the spring force of a compression spring 27. The force is transmitted to a further lever 28, which is deflected and brings about the torsion of the torsion bar 18, since this further lever 28 is connected to the torsion bar 18 in a manner fixed against relative rotation. With the aid of a spindle 29, the force for deflecting the lever 28 can additionally be adjusted. The torsion bar 18 serves to restore the seat 3 upon relief.

If the seat 3 is lowered by exertion of weight in the direction of the arrow 24 to the rear, the result, via the first lever 22, which is located in a manner fixed against relative rotation on the center shaft 14, is a rotation of this center shaft 14. As a result, the connecting elements 13 and the sliding pieces 11 secured to them are moved to the rear, and as a result of that the backrest is adjusted synchronously in its inclination relative to the seat 3.

From the sequence of FIGS. 4*a* through 5*b*, the possibilities for reclining the seat 3 and the backrest 2 out of a basic position (FIGS. 4*a* and 4*b*) into a relaxed position (FIGS. 5*a* and 5*b*) can be seen. Possible shifts in weight by the seated person are represented by arrows.

It will be understood that each of the elements described above, or two or more together, may also find a useful application in other types of constructions differing from the types described above.

While the invention has been illustrated and described as embodied in a chair, it is not intended to be limited to the details shown, since various modifications and structural changes may be made without departing in any way from the spirit of the present invention.

Without further analysis, the foregoing will so fully reveal the gist of reveal present invention that others can, by applying current knowledge, readily adapt it for various applications without omitting features that, from the standpoint of prior art, fairly constitute essential characteristics of the generic or specific aspects of the invention.

What is claimed as new and desired to be protected by letters patent is set forth in the appended claims.

What is claimed is:

1. A chair, comprising a seat; a center column; a seat support bar joined to said center column; and a mechanism for securing said seat with adjustable inclination to said seat support bar, said mechanism including a toggle lever assembly, wherein said toggle lever assembly includes a first lever secured to said seat at a stationary center shaft, and a second lever pivotally connected to said seat support bar at a stationary pivot shaft, said first and second levers being pivotally connected to one another at a shiftable pivot shaft; and further means for connecting said shiftable pivot shaft to said seat.

2. A chair as defined in claim 1; and further comprising a backrest; and a mechanism for adjusting an inclination of said backrest.

3. A chair as defined in claim 2, wherein said mechanism for adjusting an inclination of said backrest includes at least one sliding piece which is supported on said seat displaceably relative to said seat; and a backrest support bar which is fixedly joined to said sliding piece and through which said backrest is connected to said sliding piece.

4. A chair as defined in claim 3; and further comprising a curved bar which is stationarily connected with said seat and on which said sliding piece is supported.

5. A chair as defined in claim 3; and further comprising a center shaft rotatably mounted on said seat, said sliding piece being mounted on one side of said seat which is diametrically opposite to another such sliding piece, said sliding pieces being secured each to said center shaft via a connecting element.

6. A chair as defined in claim 3; and further comprising a gas spring which is connected with said sliding piece and is configured for locking said sliding piece.

7. A chair as defined in claim 1; and further comprising a center shaft rotatably mounted on said seat, said first lever of said toggle lever assembly being connected to said center shaft in a manner fixed against relative rotation.

8. A chair, comprising a seat; a center column; a seat support bar joined to said center column; and a mechanism for securing said seat with adjustable inclination to said seat support bar, said mechanism including a toggle lever assembly, wherein said toggle lever assembly includes a first lever secured to said seat at a stationary center shaft, and a second lever pivotally connected to said seat support bar at a stationary pivot shaft, said first and second levers being pivotally connected to one another at a shiftable pivot shaft; further means for connecting said shiftable pivot shaft to said seat; a telescopic element; a further lever; and a torsion bar, said shiftable pivot shaft being connected to said torsion bar via said telescopic element and said further lever, said further lever being connected to said torsion bar in a manner fixed against relative rotation.

9. A chair as defined in claim 8; and further comprising a compression spring, said telescopic element being configured as a pin that is introducible into a receptacle counter to a force of said compression spring.

* * * * *